US007900968B2

(12) United States Patent
Camwell et al.

(10) Patent No.: US 7,900,968 B2
(45) Date of Patent: Mar. 8, 2011

(54) ELECTRICAL ISOLATION CONNECTOR FOR ELECTROMAGNETIC GAP SUB

(75) Inventors: Paul L. Camwell, Calgary (CA); Derek W. Logan, Calgary (CA); David D. Whalen, Calgary (CA); Thomas H. Vermeeren, Spruce Grove (CA); Anthony R. Dopf, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 892 days.

(21) Appl. No.: 11/674,343

(22) Filed: Feb. 13, 2007

(65) Prior Publication Data

US 2008/0191900 A1 Aug. 14, 2008

(51) Int. Cl.
*F16L 11/12* (2006.01)

(52) U.S. Cl. ..... 285/47; 285/333

(58) Field of Classification Search ..... 285/48, 285/50, 333, 334, 47

See application file for complete search history.

(56) References Cited

U.S. PATENT DOCUMENTS 1,040,971 A * 10/1912 Wirt ..... 285/50
1,110,947 A 9/1914 Lampert
1,223,591 A * 4/1917 Layne ..... 285/15
1,799,941 A * 4/1931 Wulle ..... 285/323
1,832,713 A * 11/1931 Leinau ..... 285/355
1,859,311 A 5/1932 McEvoy, Jr.
1,888,241 A * 11/1932 Rah ..... 285/50
2,364,957 A 12/1944 Douglas
2,407,553 A 9/1946 Hoesel
2,437,843 A 3/1948 Ness
2,622,124 A 12/1952 Homer
2,885,224 A * 5/1959 Campbell et al. ..... 285/30
2,917,704 A 12/1959 Arps
2,940,787 A 6/1960 Goodner
3,018,119 A * 1/1962 Champion ..... 285/50
3,101,207 A 8/1963 Pavel et al.
3,687,493 A 8/1972 Lock et al.
3,822,902 A * 7/1974 Maurer et al. ..... 285/94
3,866,678 A * 2/1975 Jeter ..... 340/854.3
3,936,078 A * 2/1976 Wallyn ..... 285/49
4,126,338 A * 11/1978 Coel et al. ..... 285/330
4,348,672 A 9/1982 Givler
4,496,174 A 1/1985 McDonald et al.
4,674,773 A 6/1987 Stone et al.
5,138,313 A * 8/1992 Barrington ..... 340/854.6
5,406,983 A * 4/1995 Chambers et al. ..... 138/109
5,749,605 A * 5/1998 Hampton et al. ..... 285/48
5,833,541 A 11/1998 Turner et al.
6,050,353 A 4/2000 Logan et al.
6,158,532 A 12/2000 Logan et al.
6,371,224 B1 * 4/2002 Freeman et al. ..... 175/323
7,326,015 B2 * 2/2008 Reynolds, Jr. ..... 411/424
7,387,167 B2 * 6/2008 Fraser et al. ..... 285/53

* cited by examiner

*Primary Examiner* — David E Bochna
(74) *Attorney, Agent, or Firm* — Ryan A. Schneider, Esq.; Troutman Sanders, LLP

(57) ABSTRACT

A gap sub assembly can be used to form an electrical isolation in a drill string, across which a voltage is applied to generate a carrier signal for an electromagnetic (EM) telemetry system. The assembly comprises two conductive generally cylindrical components fashioned with a matching set of male and female rounded coarse threads, held such that a relatively uniform interstitial space is formed in the overlap space between them. The third component is a substantially dielectric electrical isolator component placed into the gap between the threads that effectively electrically isolates the two conductive components. Injecting the dielectric material under high pressure forms a tight bond resistant to the ingress of conductive drilling fluids (liquids, gases or foam), thus forming a high pressure insulating seal.

7 Claims, 11 Drawing Sheets

ELECTRICAL ISOLATION CONNECTOR FOR ELECTROMAGNETIC GAP SUB

CROSS-REFERENCE TO RELATED APPLICATIONS

Under the provisions of 35 U.S.C. §119, this application claims the benefit of Canadian Application No. 2,577,734 filed 9 Feb. 2007.

BACKGROUND OF THE INVENTION

1. Field of the Invention

This invention relates to an electrical isolation connector for interconnecting adjacent conductive components such as tubular drill rods of a drilling system used in drilling bore holes in earth formations.

2. Description of Related Art

Modern drilling techniques employ an increasing number of sensors in downhole tools to determine downhole conditions and parameters such as pressure, spatial orientation, temperature, gamma ray count etc. that are encountered during drilling. These sensors are usually employed in a process called 'measurement while drilling' (MWD). The data from such sensors are either transferred to a telemetry device, and thence up-hole to the surface, or are recorded in a memory device by 'logging'.

The oil and gas industry presently has a choice of telemetry methods:

- Wireline (cable between downhole transmitter and surface receiver)
- Mud Pulse (downhole transmitter creates pressure waves in the drilling fluid that are detected at the surface)
- Electromagnetic (EM—downhole transmitter creates very low frequency EM waves in the formation adjacent to the well that are detected at the surface)
- Acoustic (downhole transmitter creates acoustic waves in drill pipe that travel to and are detected at the surface)

In EM telemetry systems, the downhole carrier signal is produced by applying an alternating electric current across an electrically isolated (nonconductive) portion of the drill string. The required isolation is provided by a mechanically strong gap in a portion of drill string (called a 'sub') in order to maintain the torsional, bending etc. properties required for the drilling process. The EM signal originating across the gap is subsequently detected on the surface by, in general, measuring the induced electric potential difference between the drill rig and a grounding rod located in the earth some distance away.

Nonconductive materials forming the isolation section of the gap sub typically have inherently less strength and ductility than the conductive steel materials of the drill pipe, giving rise to complex designs that are necessary to complement the structural strength of drill pipe.

As described by several patent publications, many types of electrical isolation arrangements exist for the purpose of signal transmission in a drill string. Although these systems electrically isolate and seal while being subjected to drilling loads, they generally do so with a complicated multi-component design that thus becomes a relatively expensive device. Examples of such complicated and expensive designs are disclosed in U.S. Pat. Nos. 6,158,532 and 6,050,353 assigned to Ryan Energy Technologies, Inc. (Calgary, Calif.) whereby many separate components of the assembly are shown to be necessary in order to resist axial, bending and torsion forces.

It is also common knowledge in the oil and gas industry that a two-part epoxy-filled gap between coarse threads can be used to resist both axial and bending loads. Reverse torsion, which would tend to uncouple the joint, can be resisted by the insertion of dielectric pins into carefully fashioned slots. Since epoxy does not adequately seal against drilling pressures of typically 20,000 psi, additional components must be included to provide an elastomeric seal, again leading to mechanical complexity and added cost.

SUMMARY OF THE INVENTION

Gap sub assemblies in directional drilling service are subjected to severe and repetitive axial, bending and torsional loads. Existing designs incorporate many parts that are designed to independently resist each force, giving rise to complex and costly mechanical arrangements. It is an object of the present invention to overcome in as simple a manner as possible the complex and difficult issues faced by existing gap sub designs.

According to one aspect of the invention there is provided a gap sub assembly comprising: a female conductive component having a connecting end; a male conductive component having a connecting end inserted into the connecting end of the female conductive component; and an electrical isolator component comprising a substantially dielectric and annular body located between the male and female conductive components. The annular body is located between the male and female conductive components such that the conductive components are mechanically coupled together but electrically isolated from each other at their connecting ends. At least one of the male and female conductive components has a cavity in a surface of its connecting end. The annular body has a barrier portion protruding into each cavity of the male and female components to impede at least the rotation of the conductive component relative to the body. The material of the electrical isolator component can be a thermoplastic. Also, the isolator component can be located between the male and female conductive components such that a drilling fluid seal is established at the connecting ends of the male and female conductive components.

The annular body can be located between and around threaded connecting ends of the male and female conductive components in which case the barrier portion is positioned relative to the corresponding conductive component to resist rotation thereof relative to the electrical isolator component. Alternatively, the annular portion can be located between and around smooth connecting ends of the male and female conductive components.

The cavity can be a groove extending generally parallel to an axis of the conductive component and into the threaded connecting end thereof, in which case the barrier portion protrudes into the groove thereby providing resistance against rotation of the conductive component relative to the electrical isolator component.

The cavity can be a curved groove extending at an angle the axis of the conductive component and into the threaded connecting end thereof in which case the barrier portion protrudes into the groove thereby providing resistance against rotation and axial translation of the conductive component relative to the electrical isolator component.

The barrier portion can protrude from the annular portion and extend across the annular portion at a generally acute angle relative to the axis of the annular portion thereby providing resistance against both rotation and axial translation of the corresponding conductive component relative to the electrical isolator component.

Both the male and female conductive components can comprise at least one cavity in the surface of their respective connecting ends, in which case the electrical isolator component comprises at least two barrier portions, namely a first barrier portion that protrudes into a corresponding cavity in the male conductive component, and a second barrier portion that protrudes into a corresponding cavity in the female conductive component.

At least one of the male and female conductive components can comprise multiple spaced cavities and the electrical isolator component can comprise multiple barrier portions that protrude into the cavities.

According to another aspect of the invention, there is provided an electrical isolator component for a gap sub assembly, comprising a substantially dielectric and annular body located between male and female conductive components of the gap sub assembly such that the conductive components are mechanically coupled together but electrically isolated from each other, the body having a barrier portion protruding into a corresponding cavity of the male or female component to impede at least the rotation of the conductive component relative to the body.

According to yet another aspect of the invention, there is provided a method of electrically isolating male and female conductive components in a gap sub assembly comprising:

providing a cavity on a surface of at least one of the conductive components of the gap sub assembly;

inserting a connecting end of the male conductive component into a connecting end of the female conductive component;

softening a substantially plastic dielectric material and injecting the softened dielectric material in between the connecting ends of the male and female conductive components to form a substantially annular body and into the cavity to from a barrier portion protruding from the body;

hardening the dielectric material to form an electrical isolator component comprising the body with barrier portion that mechanically couples the conductive components together, electrically isolates the conductive components from each other and impedes movement of the conductive component having the cavity relative to the electrical isolator component.

BRIEF DESCRIPTION OF THE DRAWINGS

The following drawings illustrate the principles of the present invention and exemplary embodiments thereof.

DETAILED DESCRIPTION OF THE PREFERRED EMBODIMENTS

According to one embodiment of the invention, an electrical isolator component for an EM gap sub assembly provides both electrical isolation and an anti-rotation means between two connected conductive components of the gap sub assembly and optionally also provides a fluid seal between the interior and exterior of the gap sub assembly. The gap sub assembly can be used to form an electrical isolation in a drill string, across which a voltage is applied to generate a carrier signal for an electromagnetic (EM) telemetry system. In the embodiments shown in FIGS. 1 to 6, the electrical isolator component comprises a dielectric material that fills a cavity between rounded, coarse (as would be understood to those skilled in the art), tapered threads of male and female threaded conductive components of the assembly. A high-pressure seal is formed by injecting nonporous dielectric material at high pressure into the interstitial cavity between male and female jointed sections proximate to the threaded portions. The preferred embodiment is manufactured by fixing the conductive components in an injection molding machine and injecting a high temperature, high strength thermoplastic into the equidistant cavity formed between the threads. A suitably high temperature is required in the molding process in order that the injectant remains able to beneficially flow and completely fill the cavity between the male and female components. Once filled, a holding pressure (typically ~20,000 psi) is maintained until the thermoplastic solidifies. In certain oil and gas drilling applications this procedure forms a tight seal against penetration of potentially conductive drilling fluids into the gap sub assembly, as well as prevents the adjacent conductive components of the gap sub assembly from rotating relative to each other.

Figure 9:
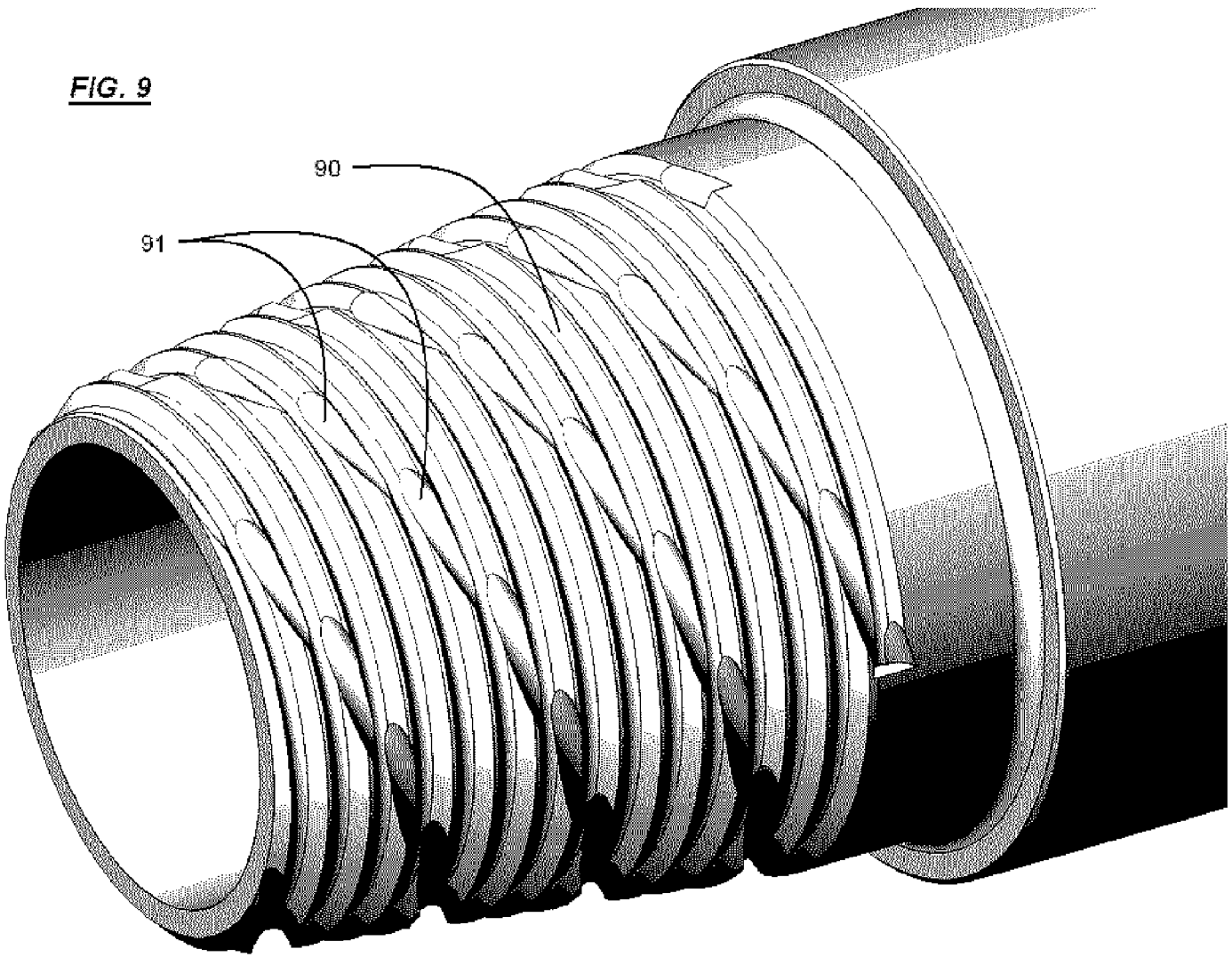
FIG. 9 is a perspective view of a male threaded conductive component according to an alternative embodiment having an anti-rotation forming means fashioned as a reverse thread overlapping the original thread.
Figure 10:
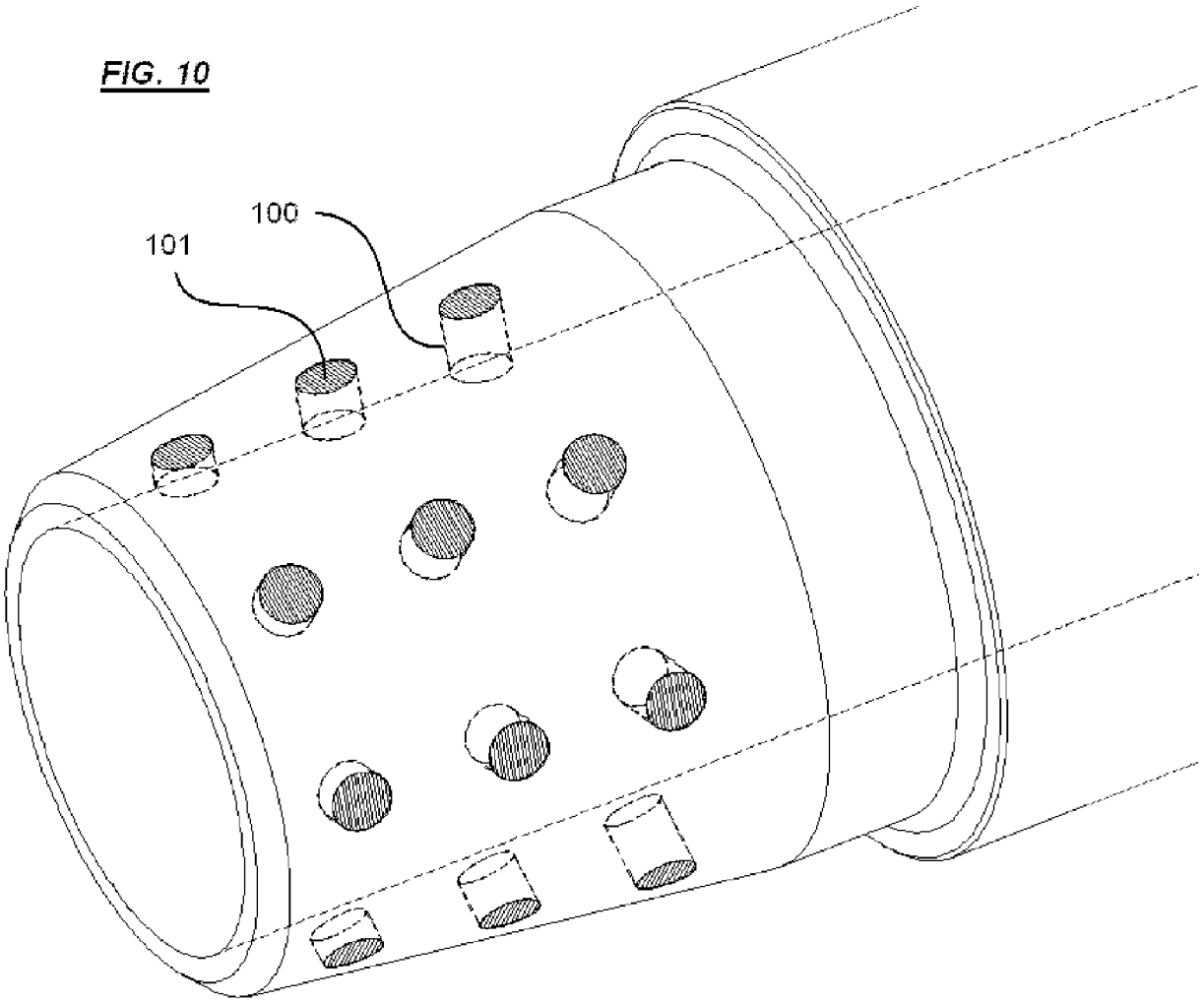
FIG. 10 is a perspective view of a male conductive component according to another alternative embodiment having an anti-rotation forming means provided by drill holes in the surfaces of both the male and female conductive components.
Figure 11:
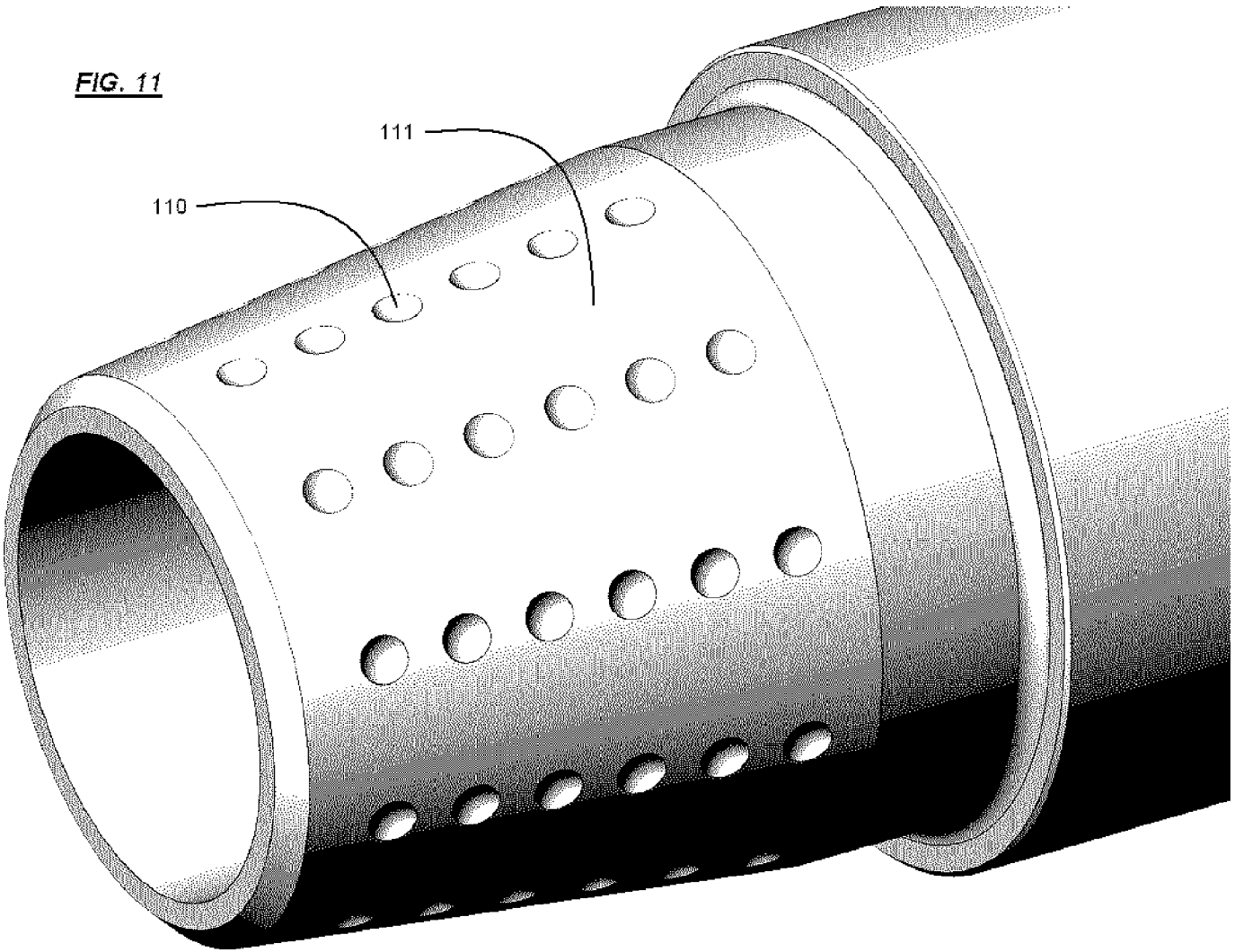
FIG. 11 is a perspective view of a smooth core cavity (no threads) male conductive component according to yet another alternative embodiment and having an anti-rotation forming means provided by dimples in the cavity surface.

Anti-rotation, i.e. torsion resistance, is provided by means which require parts of the dielectric material to shear in order to disassemble the threaded section under torsion loading. In the embodiments shown in FIGS. 3 to 8, such means are provided by an elongated barrier of dielectric material protruding from the electrical isolator component and formed by elongated "grooves" or "slots" in the surfaces of one or both of the male and female conductive components. FIGS. 9 to 11 show alternative anti-rotation means, namely embossments on the electrical isolator component formed by drill holes, dimples, and a reverse thread in one or both conductive components. Such grooves, slots, holes, dimples and reverse threads are generally referred herein to as "barrier forming cavities". While specific examples of anti-rotation means are shown in these FIGS., other means that utilize the direct shearing of an interstitial dielectric material to resist rotation are within the scope of this invention; such means can include barriers formed by the machining cavities of various geometries into the surfaces of one or both of the conductive gap sub components.

Although the embodiments are described herein are in the context of oil and gas drilling applications, a connector having sealing and anti-rotation means can be used in other applications within the scope of the invention, such as surface oil and gas pipelines, water or food conveying pipes, chemical plant pipelines etc.

Referring to FIGS. 1 to 5, and according to a first embodiment, a gap sub assembly 1 comprises three major parts, namely male and female threaded conductive components 10 and 12, and an electrical isolator component 11 made of a thin dielectric material (hereinafter "dielectric component"). The conductive components 10 and 12 are comprised of a non-magnetic, high strength, stainless steel alloy, having box 13 and pin 14 connections on either end to allow for direct attachment to a drill collar section of the bottom hole assembly (BHA) of a typical drill string (not shown). Male conductive component 10 has a tapered and rounded coarse male threaded end while female conductive component 12 has a matching female threaded end. In this embodiment, the dielectric component 11 is a thermoplastic material injected under high pressure into the interstitial space between the equidistant male and female threads of the conductive components 10, 12. The injected thermoplastic fills barrier forming cavities in the conductive components to form the anti-rotation barriers, and between the conductive component threads to electrically isolate the conductive components 10, 12 from each other. Suitable thermoplastics include polyethylethylketone (PEEK), polyetherimide (PEI), and polyetherketone (PEK) which exhibit good high temperature properties.

The method of forming the dielectric component 11 by injecting thermoplastic material in between the threads of the conductive components 10 and 12 will now be described.

First, the gap sub assembly 1 is assembled by loosely screwing the threaded ends of the male and female conductive components 10, 12 together in an axially symmetric arrangement.

Then, the threaded connecting ends of two conductive components 10, 12 are fixed in a mold of an injection molding machine (not shown) such that the tapered threads overlap but do not touch. Such injection molding machine and its use to inject thermoplastic material into a mold is well known the art and thus are not described in detail here. The mold is designed to accommodate the dimensions of the loosely screwed together gap sub assembly 1 in a manner that the thermoplastic injected by the injection molding machine is constrained to fill the gaps in between the threads.

Then, the thermoplastic material is injected in a softened form ("injectant") into an equidistant gap 20 formed between the threads of the conductive components 10, 12, into the barrier forming cavities (e.g. groove 30 shown in FIG. 3) of the conductive components 10, 12, and into the annular channels 21, 22 at each end of the gap 20. The mold temperature, thermoplastic temperature, flow rate, and pressure required to beneficially flow the injectant and completely fill these spaces are selected in the manner as known in the art. Once filled, a holding pressure (typically ~20,000 psi) is maintained until the thermoplastic injectant solidifies and the dielectric component 11 is formed.

After the thermoplastic material solidifies and become mechanically rigid or set, formation the dielectric component 11 is complete and the conductive components 10, 12 can be removed from the injection molding machine. The dielectric component 11 now firmly holds the two conductive components 10, 12 together mechanically, yet separates the components 10, 12 electrically. The dielectric component 11 also provides an effective drilling fluid barrier between the inside and outside of the gap sub assembly 1.

Figure 1:
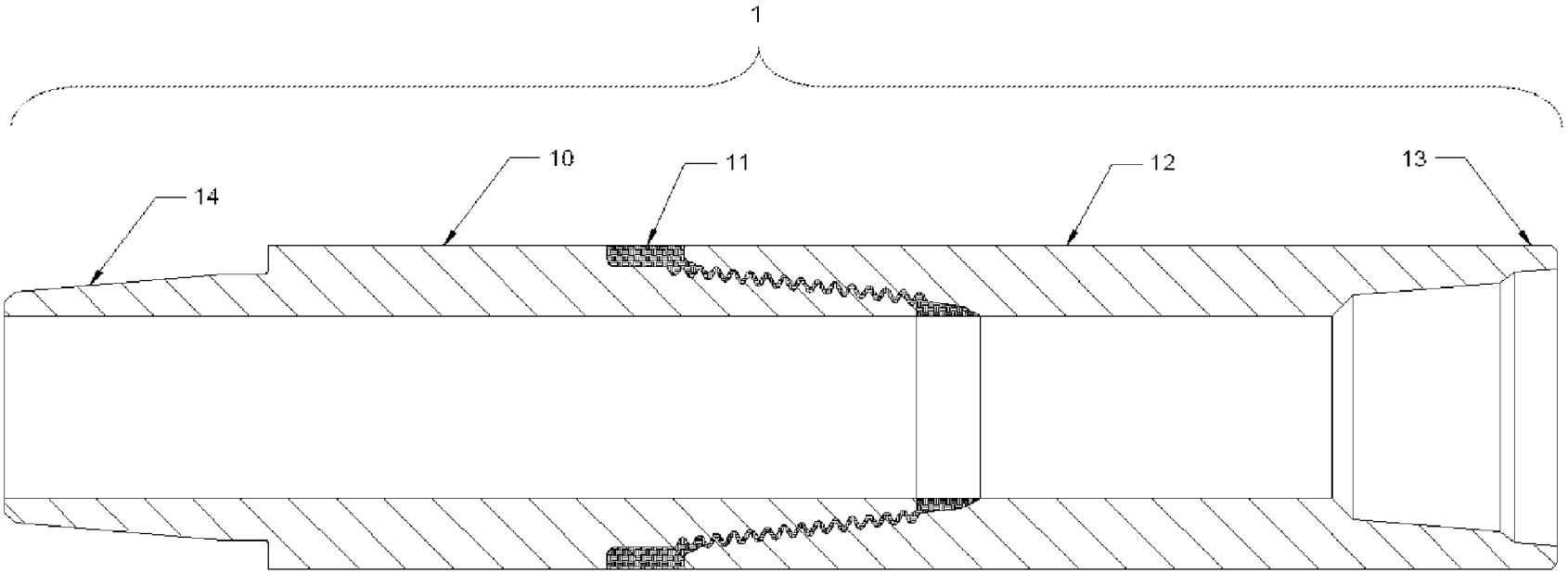
FIG. 1 is a cross-sectional view of a three-part gap sub assembly according to one embodiment of the invention and comprising male and female threaded conductive components separated by an electrical isolation component made of a dielectric material.
Figure 2:
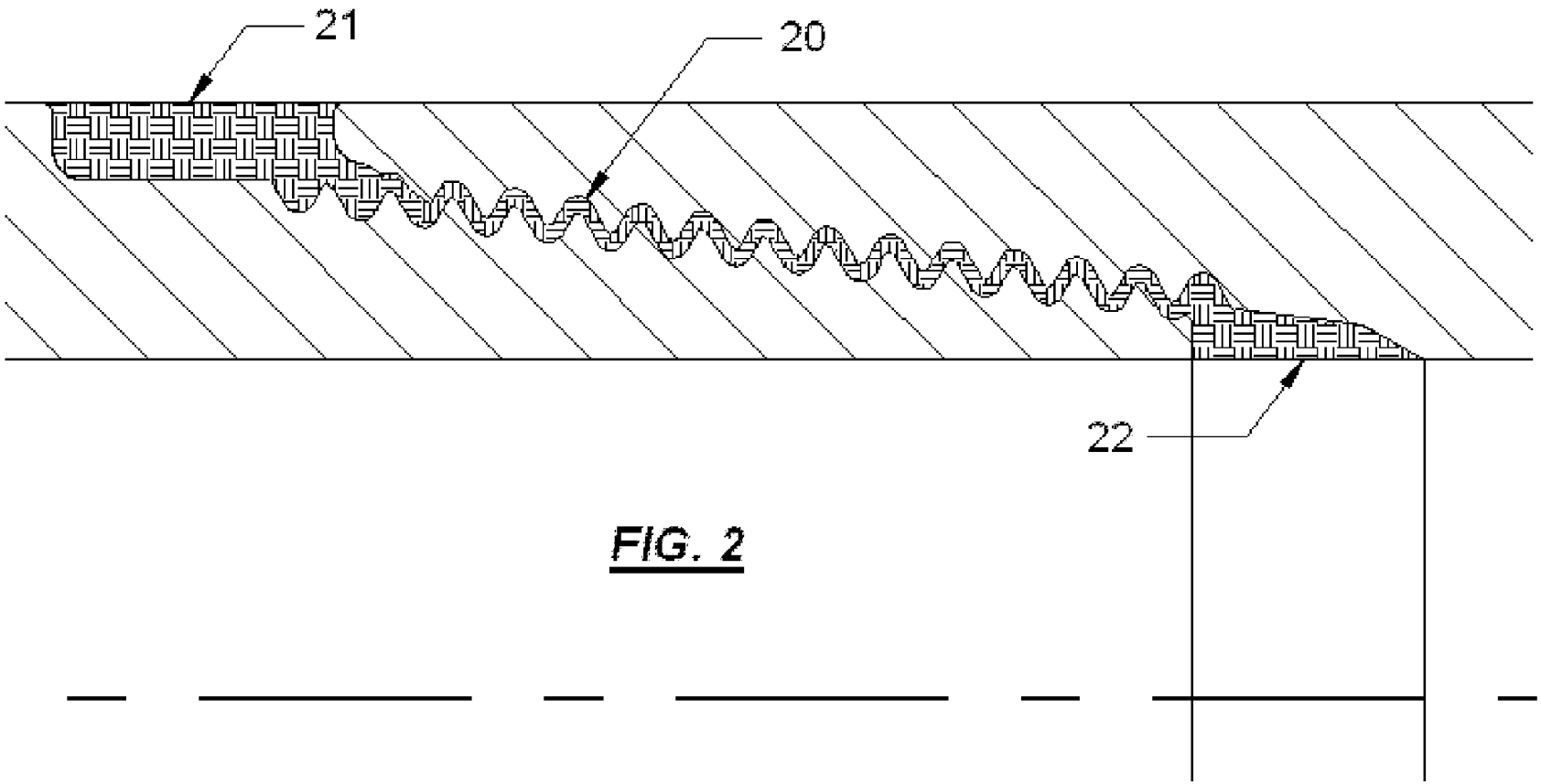
FIG. 2 is a detailed cross-sectional view of the dielectric component after injection into a gap between equidistant coarse threads of the male and female threaded components.
Figure 4:
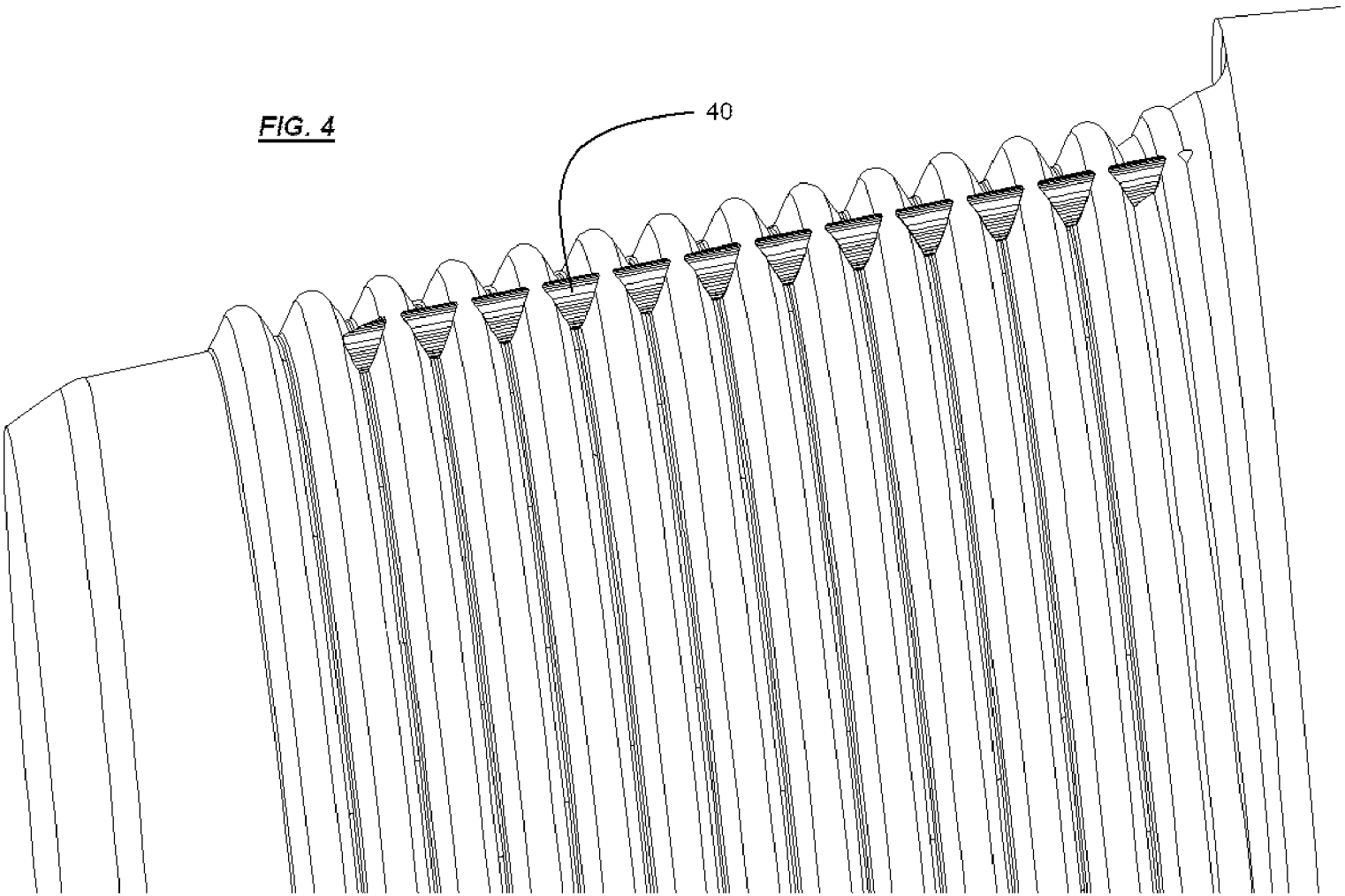
FIG. 4 is a perspective view of the dielectric component having an anti-rotational barrier produced by an elongated groove machined into the threads of the female threaded conductive component.
Figure 5:
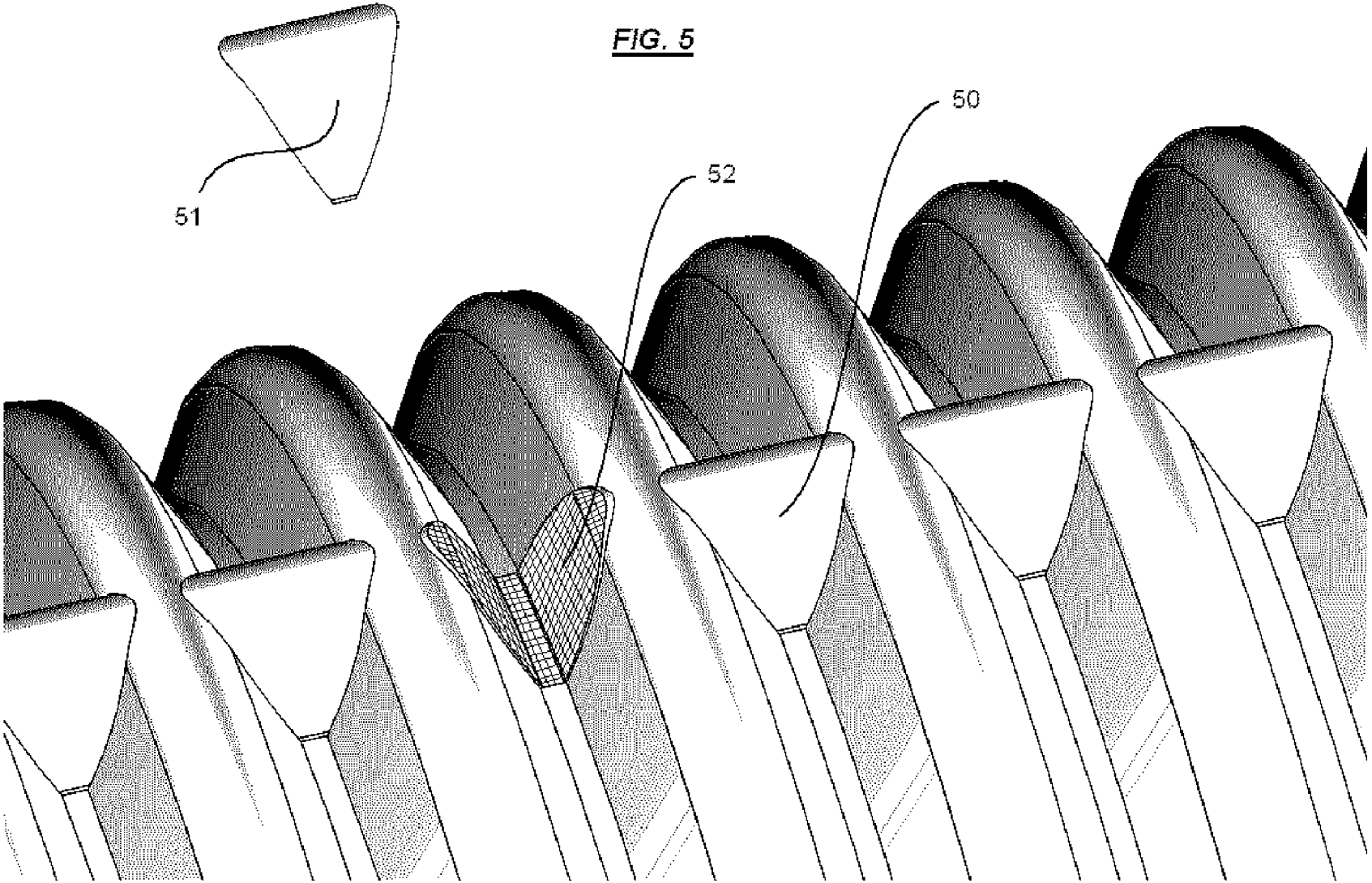
FIG. 5 is a perspective view showing one anti-rotation segment shearing away from the remainder of the barrier.

FIG. 2 provides a closer view of the dielectric component (11 of FIG. 1) after injection into the gap between generally equidistant coarse threads 20. The dielectric component 11 is generally annular, having an annular outer end 21, an annular inner end 22, and an annular undulating interconnect portion interconnecting the outer and inner ends 21, 22. The dielectric component 11 also has a pair of anti-rotation barriers that are not shown in this figure but is shown in FIGS. 4 and 5 and discussed below. The outer and inner end ends 21, 22 are respectively exposed on the outer and inner surfaces of the gap sub assembly 1 of with sufficient distance between the conductive components (10, 12 of FIG. 1) to provide the electrical isolation necessary for an EM telemetry sub to function.

As is well known in the art, the tapered coarse threads in this application efficiently carry both axial and bending loads, and the interlock between the threads provides added mechanical integrity should the dielectric component be compromised for any reason. The dielectric component provides an arrangement that is self-sealing since the dielectric material is nonporous, free from cracks or other defects that could cause leakage, and was injected and allowed to set under high pressure. As a result, drilling fluids cannot penetrate through the dielectric material (11 of FIG. 1) and cannot seep along the boundary between the dielectric component and the surfaces of the clean conductive components (10, 12 of FIG. 1). Thus no additional components are necessary to seal this assembly.

Referring to FIG. 1, without the anti-rotation feature provided by the dielectric component 11, reverse torsion tending to uncouple the coarse threads would be resisted only by the bonding strength between the dielectric material and the surfaces of the conductive components 10, 12, which tends to be of insufficient strength to carry the drilling loads normally encountered.

Figure 3:
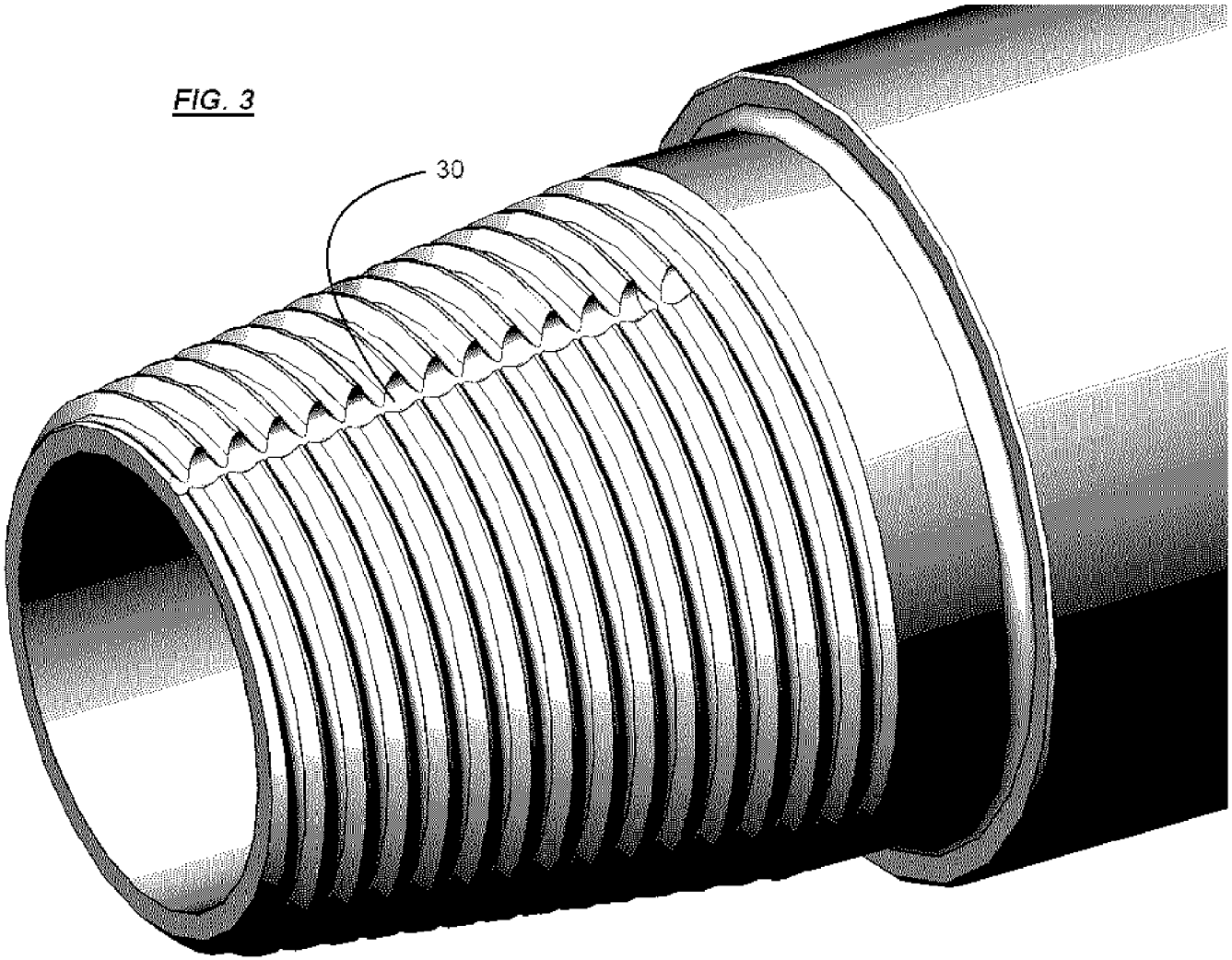
FIG. 3 is a perspective view of the male threaded conductive component having an anti-rotation groove fashioned into the threads.

In the embodiment shown in FIG. 3 and referring to FIG. 1, torsion resistance is achieved by a pair of elongated barriers which are formed by injecting dielectric material into grooves in the surfaces of the male and female components 10, 12. A groove 30 in the male threaded component 10 prevents the dielectric component 11 from rotating with respect to the male conductive component 10. A similar groove in the female threaded component 12 (not shown) prevents the dielectric component 11 from rotating with respect to the female conductive component 12. As is obvious to one skilled in the art, grooves in both the male and female conductive components 10, 12 are necessary to adequately resist torsion with there being no need for the grooves to be proximately aligned.

As shown in FIG. 4 and referring to FIGS. 1 and 3, each barrier 40 extends longitudinally along the interconnect portion of the dielectric component 11. The barrier 40 shown in FIG. 4 has been formed by injecting dielectric material into the groove (similar to 30 but not shown) in the female conductive component 12. Segments of the barrier 40 are shaded in this figure to better illustrate the portions of dielectric material that must be sheared in order to decouple the connection between the male and female conductive components 10, 12. These segments are herein referred to as anti-rotation segments. In this embodiment, the first barrier 40 provides shear resistance against the female threads, and a second barrier (not shown) is provided which provides shear resistance against the male threads. In an alternative embodiment, only a single barrier is provided, proximate to either the male or female threads, providing some torsion resistance. However, it is clear that having a barrier preventing rotation of both male and female threads with respect to the dielectric material provides better torsion resistance than a single barrier. This is because the threads which do not have a barrier will be easier to unscrew than the threads which incorporate a barrier.

FIG. 5 illustrates what must happen for the female threads to uncouple from the dielectric component 11. All segments 50 must shear away from the remainder of the dielectric material simultaneously (for clarity, only one sheared segment 51 is shown). The crosshatched pattern 52 shows the 'shear area' of one anti-rotation segment 51. Varying the depth of the groove (30 of FIG. 3) will affect the shear area of each segment. The torsion resistance of each individual segment is determined by multiplying the shear area with the shear strength of the dielectric material and the moment arm, or distance from the center axis, as the following equation denotes:

$$T_i = A_i S D_i$$

where: $T_i$ is the torsion resistance of an individual anti-rotation segment, $A_i$ is the area of dielectric material loaded in pure shear, S is the shear strength of the dielectric material, and $D_i$ is the segment moment arm or distance from the center axis.

Figure 6:
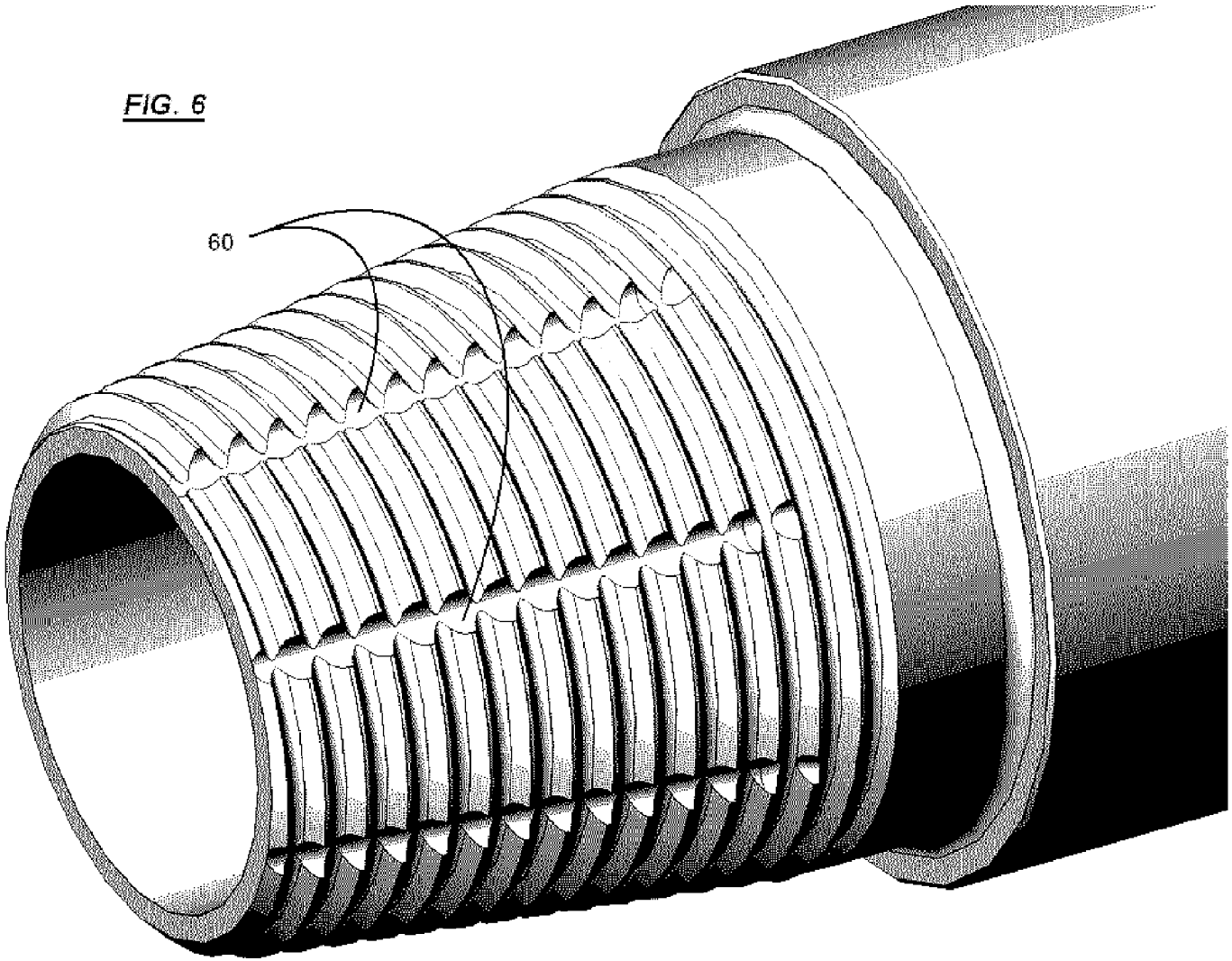
FIG. 6 is a perspective view of a male threaded conductive component having multiple grooves for producing multiple anti-rotation barriers in the dielectric component according to an alternative embodiment.

Referring to FIG. 6 and according to another embodiment, the male threaded conductive component 10 has multiple anti-rotation grooves 60 that create a dielectric component having multiple barriers (not shown) against the male threads. Multiple barriers provide additional shear resistance over a single barrier. In this embodiment, corresponding grooves are found in the female threaded component 12 to provide multiple barriers against the female threads, but are not shown. Torsion resistance between the dielectric component 11 (referring to FIG. 1) and the male component 10 (or the dielectric component 11 and the female component 12) is determined by the sum of the resistances provided by each individual segment, as follows:

$$T_M \text{ or } T_F = \sum_{1}^{N_{slot}} \sum_{1}^{N_{seg}} T_i = \sum_{1}^{N_{slot}} \sum_{1}^{N_{seg}} A_i S D_i$$

where: $T_M$ is the torsion resistance between dielectric component and male conductive component $T_F$ is the torsion resistance between dielectric component and female conductive component $N_{seg}$ is the number of anti-rotation segments per slot $N_{slot}$ is the number of slots in male or female conductive component Since rotation of the dielectric component 11 with respect to either of the conductive components 10, 12 would constitute decoupling of the joint, torsion resistance for the entire joint is the lesser of $T_M$ or $T_F$.

As illustrated, the torsion resistance provided by this embodiment is a function of geometry and the shear strength of the material. With the formulae presented and routine empirical testing to confirm material properties, the quantity of anti-rotation segments required to produce any desirable safety margin is easily determined by one skilled in the art.

Figure 7:
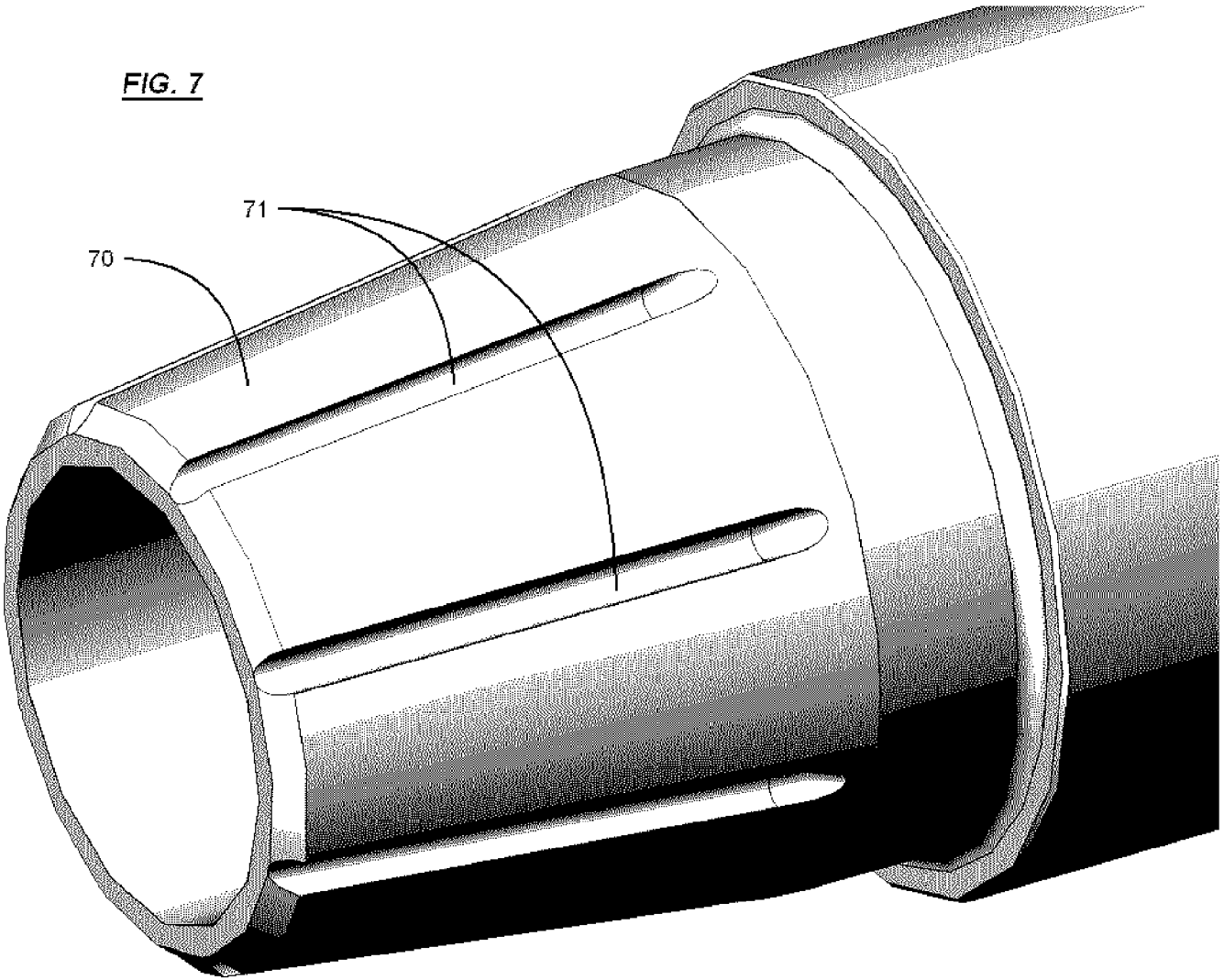
FIG. 7 is a perspective view of a smooth core cavity (no threads) of a male conductive component having an elongated groove according to an alternative embodiment.

Referring to FIG. 7 and according to another embodiment, a male conductive component 70 has a smooth bore cavity surface (no threads) having multiple milled straight grooves 71. These grooves 71 create a dielectric component having multiple elongated straight barriers (not shown). Similar straight grooves are found in a female (non-threaded) conductive component that creates multiple barriers to rotational movement in the dielectric component (not shown) with respect to the female conductive component. The barriers themselves provide torsion resistance, illustrating that a thread form is not required to provide torsion resistance. In FIGS. 1 to 6, the thread form is present to resist axial and bending loads, and does not contribute to torsion resistance.

Figure 8:
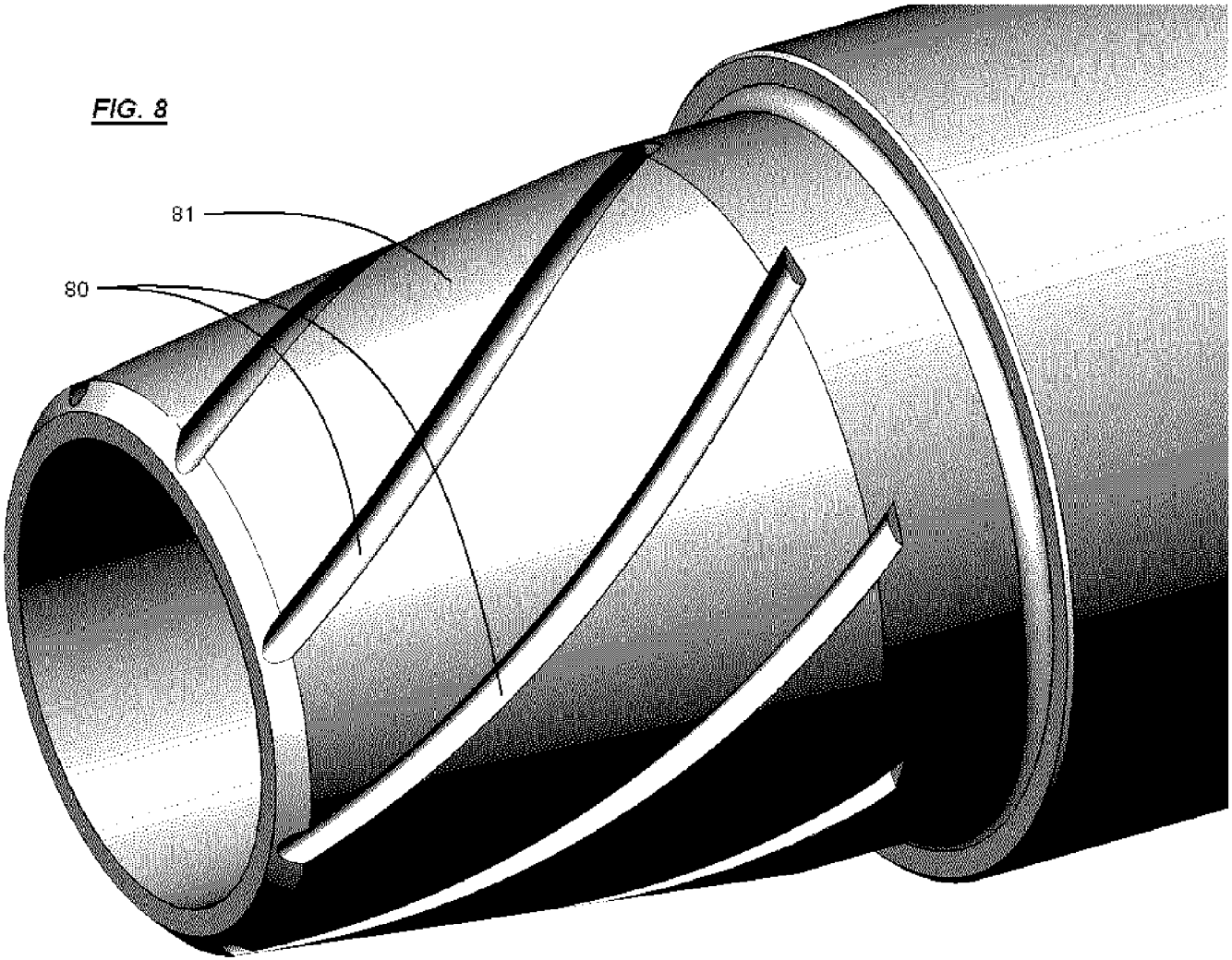
FIG. 8 is a perspective view of the smooth core cavity of FIG. 7 modified to have a curved and elongated groove.

Referring to FIG. 8 and illustrating another embodiment, a smooth cavity surface is shown that has multiple milled curved grooves 80 that extend at an angle to the axis of the male conductive component 81. The grooves 80 create a dielectric component (not shown) having curved and angled barriers that provide both axial and torsion resistance against the male conductive component 81. Similar curved grooves are found in the female conductive component (not shown) that serve to create a dielectric component having curved and angled barriers (not shown) that provide both axial and torsion resistance against the female conductive component.

Referring to FIG. 9 and illustrating a further embodiment, the threaded surface of the male conductive component 90 is provided with curved grooves that are fashioned as a reverse thread 91 overlapping the original thread. A similar reverse thread is found in the threaded surface of the complementary female conductive component (not shown). The grooves in both conductive components create curved barriers in a dielectric component (not shown). The torsion resistance provided by these barriers can be adjusted by adjusting the characteristics of the grooves, e.g. the pitch and the number of thread starts and thread profiles.

As can be seen in the embodiments illustrated in FIGS. 7 to 9, the male and female conductive components (10 and 12 of FIG. 1) can be provided with grooves of any reasonable size, shape, and path to create a dielectric component (11 of FIG. 1) having the exact axial and torsional resistance desired.

Referring to FIG. 10 and illustrating another embodiment, holes 100 are drilled into the surfaces of both male and female conductive components (10 and 12 of FIG. 1). Although a male conductive component having a smooth bore cavity is shown in this figure, similar holes can be provided in threaded conductive components. Drill holes 100 serve as molds for creating multiple barriers in the dielectric component (not shown). The hatched regions 101 indicate shear areas of the barriers, and the 'hidden' lines 100 illustrate that material remains in the holes after shearing. Although multiple rows of drill holes are shown in this figure, a different number and layout of holes can be provided within the scope of the invention.

Referring to FIG. 11 and illustrating yet another embodiment, dimples 110 are provided in the surfaces of both male and female conductive components (10 and 12 of FIG. 1). Although a male conductive component 111 having a smooth bore cavity is shown in this figure, similar dimples 110 can be provided in threaded conductive components. Dimples serve as molds for creating multiple barriers in the dielectric component (not shown). Such dimples can be fashioned into the material by forms of plastic deformation (e.g. pressed or impacted) or material removal (e.g. grinding, milling, sanding, etc.). Although multiple rows of dimples are shown in this figure a different number and layout of dimples is inferred to be within the scope of the invention.

While FIGS. 10 and 11 illustrate drill holes 100 and dimples 110 for creating torsion resistance barriers in the dielectric component (11 of FIG. 1), recessed portions of other realizable patterns or shapes could be used to create barriers that would be suitable for providing suitable torsion resistance.

While the present invention has been described herein by the preferred embodiments, it will be understood by those skilled in the art that various consistent and now obvious changes may be made and added to the invention. The changes and alternatives are considered within the spirit and scope of the present invention.

What is claimed is:

1. A gap sub assembly comprising:

a female conductive component having a threaded connecting end;

a male conductive component having a threaded connecting end inserted into the connecting end of the female conductive component, whereby the connecting ends of the male and female conductive components matingly engage with each other;

at least one of the male and female conductive components having a cavity in a surface of its connecting end; and an electrical isolator component comprising a substantially dielectric and annular body located between the connecting ends of the male and female conductive components such that the conductive components are mechanically coupled together but electrically isolated from each other at their connecting ends, the annular body having a barrier portion protruding into the cavity of at least one of the connecting ends of the male and female components to impede at least the rotation of the conductive component relative to the annular body; and wherein the annular body is located between and around the threaded connecting ends of the male and female conductive components and the barrier portion is positioned relative to the corresponding conductive component to resist rotation thereof relative to the electrical isolator component.

2. A gap sub assembly as claimed in claim 1 wherein the cavity is a groove extending substantially parallel to an axis of the conductive component and into the threaded connecting end thereof, and the barrier portion protrudes into the groove thereby providing resistance against rotation of the conductive component relative to the electrical isolator component.

3. A gap sub assembly as claimed in claim 1 wherein the cavity is a curved groove extending at an angle to the conductive component axis and into the threaded connecting end thereof, and the barrier portion protrudes into the groove thereby providing resistance against rotation and axial translation of the conductive component relative to the electrical isolator component.

4. An electrical isolator component for a gap sub assembly, comprising:

a substantially dielectric and annular body for location between male and female conductive components of the gap sub assembly such that the conductive components are mechanically coupled together but electrically isolated from each other, the annular body having a barrier portion for protruding into a corresponding cavity of the male or female component to impede at least the rotation of the conductive component relative to the body;

wherein the annular portion is located between and around smooth connecting ends of the male and female conductive components; and wherein the barrier portion protrudes from the annular portion and extends across the annular portion at a generally acute angle relative to the axis of the annular portion thereby providing resistance against both rotation and axial translation of the corresponding conductive component relative to the electrical isolator component.

5. A gap sub assembly comprising a female conductive component having a threaded connecting end;

a male conductive component having a threaded connecting end inserted into the threaded connecting end of the female conductive component;

at least one of the male and female conductive components having a cavity in a surface of its connecting end; and an electrical isolator component comprising a substantially dielectric and annular body located between and around the threaded connecting ends of the male and female conductive components such that the conductive components are mechanically coupled together but electrically isolated from each other at their connecting ends, the annular body having a barrier portion protruding into the cavity of at least one of the connecting ends of the male and female components to impede at least the rotation of the conductive component relative to the annular body, wherein the cavity is a groove extending substantially parallel to an axis of the conductive component and into the threaded connecting end thereof, and the barrier portion protrudes into the groove thereby providing resistance against rotation of the conductive component relative to the electrical isolator component.

6. A gap sub assembly comprising a female conductive component having a threaded connecting end;

a male conductive component having a threaded connecting end inserted into the threaded connecting end of the female conductive component;

at least one of the male and female conductive components having a cavity in a surface of its connecting end; and an electrical isolator component comprising a substantially dielectric and annular body located between and around the threaded connecting ends of the male and female conductive components such that the conductive components are mechanically coupled together but electrically isolated from each other at their connecting ends, the annular body having a barrier portion protruding into the cavity of at least one of the connecting ends of the male and female components to impede at least the rotation of the conductive component relative to the annular body, wherein the cavity is a curved groove extending at an angle to the conductive component axis and into the threaded connecting end thereof, and the barrier portion protrudes into the groove thereby providing resistance against rotation and axial translation of the conductive component relative to the electrical isolator component.

7. A gap sub assembly comprising a female conductive component having a smooth connecting end;

a male conductive component having a smooth connecting end inserted into the smooth connecting end of the female conductive component;

at least one of the male and female conductive components having a cavity in a surface of its connecting end; and an electrical isolator component comprising a substantially dielectric and annular body located between and around the smooth connecting ends of the male and female conductive components such that the conductive components are mechanically coupled together but electrically isolated from each other at their connecting ends, the annular body having a barrier portion protruding into the cavity of at least one of the connecting ends of the male and female components to impede at least the rotation of the conductive component relative to the annular body, wherein the barrier portion protrudes from the annular body and extends across the annular body at a generally acute angle relative to the axis of the annular body thereby providing resistance against both rotation and axial translation of the corresponding conductive component relative to the electrical isolator component.

* * * * *